United States Patent [19]

Byriel

[11] Patent Number: 4,893,957

[45] Date of Patent: Jan. 16, 1990

[54] DISPENSER BRUSH

[75] Inventor: Ole Byriel, Jyllinge, Denmark

[73] Assignee: Eveline A/S, Jyllinge, Denmark

[21] Appl. No.: 275,058

[22] PCT Filed: Mar. 25, 1988

[86] PCT No.: PCT/DK88/00051

§ 371 Date: Nov. 18, 1988

§ 102(e) Date: Nov. 18, 1988

[87] PCT Pub. No.: WO88/07339

PCT Pub. Date: Oct. 6, 1988

[30] Foreign Application Priority Data

Mar. 26, 1987 [DK] Denmark ..... 1559/87

[51] Int. Cl.[4] ..... A46B 11/02

[52] U.S. Cl. ..... 401/146; 401/149; 401/150; 401/151; 401/279

[58] Field of Search ..... 401/146, 149, 150, 151, 401/279

[56] References Cited

U.S. PATENT DOCUMENTS

| | | | |
|---|---|---|---|
| 1,446,967 | 2/1923 | Flewelling | 401/150 X |
| 1,811,512 | 6/1931 | Marsh | 401/150 X |
| 2,302,062 | 11/1942 | Schweyer | 401/150 X |
| 2,563,842 | 8/1951 | Johnson | 401/150 |
| 2,772,430 | 12/1956 | Moritt | 401/150 X |
| 3,186,024 | 6/1965 | McLemore | 401/150 |

FOREIGN PATENT DOCUMENTS

| | | |
|---|---|---|
| 146799 | 12/1977 | Norway . |
| 2066059 | 7/1981 | United Kingdom . |

*Primary Examiner*—Steven A. Bratlie

*Attorney, Agent, or Firm*—Watson, Cole, Grindle & Watson

[57] ABSTRACT

A dispenser brush for dispensing doses of an agent comprises a brush head (1), a conduit member (3) and a piston pump (4) placed between the reservoir and the dispensing openings. To obtain a very precise dosing the piston pump (4) is arranged for movement in a direction substantially normal to the longitudinal axis of the brush. The actuator button (11) of the piston may be activated by the thumb of the user while having a normal working grip around the handle.

9 Claims, 3 Drawing Sheets

DISPENSER BRUSH

BACKGROUND OF THE INVENTION

The present invention relates to a dispenser brush intended for dispensing doses of an agent and comprising a reservoir for the agent, which reservoir is provided inside or forms a part of the handle of the dispenser brush, a brush head, a conduit member connecting the reservoir and one or more dispensing openings in the brush head and a dose member interposed between the reservoir and the dispensing openings in the brush head and consisting of a piston pump which comprises a piston member, a cylinder member and a spring member biasing the piston member in the direction opposite the compression stroke and which spring member provides for the returning of the piston member outwardly of the cylinder member to its position of rest after the compression stroke of the piston member.

Dispenser brushes are known which have a reservoir for soap or another agent intended to be conveyed to the brush head and wherein the agent is dispensed dependent on a liquid flow passing through the handle of the brush to the brush head. Such brushes are used, e.g., for washing cars.

For other use it is desirable to manufacture to brush wherein the agent to be conveyed to the brush head may be dispensed solely dependent on the wishes of using a greater or smaller dose. An example of such a brush is known, e.g., from DE published application No. 2,328,823. This describes a car brush wherein a valve arrangement makes it possible to dose an additive. However, it is not possible to effect this dosage with exactness.

Moreover, it is also desirable to use a dosing in connection with brushes other than that type wherein a waterflow passes through the handle, e.g., in connection with brushes for dishwashing where the water is contained in a bowl, and brushes for washing cars with the water from a bucket.

Such a type of brush may also be used for personal hygiene or for sanitary purposes. The agents used in the brush may be in the form of low viscosity liquid agents or sluggish paste-like agents.

Examples of such brushes are known, e.g., from DE published application No. 1,811,217. This describes a toothbrush with a toothpaste reservoir, wherein the toothpaste is conducted through a duct to nozzles in the brush head by a pump. However, this construction does not give a precise dosage.

In GB published application No. 2,066,059 a construction is disclosed which, in a hairbrush, makes it possible to convey a hair treatment preparation directly from a reservoir in the brush head to the bristles by means of an associated dispensing member. However, this conveyance is unreliable too.

Seeing that an unreliable dosage often may cause a poor result of the work conducted, it is desirable with a dispenser brush to obtain a precise dosing.

In SE patent No. 439,726 a brush construction is described which makes it possible to obtain a precise dosage of an agent by means of a piston pump. However, this construction requires a very accurate manufacturing and dimensioning of the individual elements forming parts of the dose mechanism, and the activation of the pump mechanism is difficult because the reservoir itself is to be displaced backwards and forwards inside the handle part to obtain the dispensing of the agent.

Accordingly, it is the object of the present invention to provide a dispenser brush of the type mentioned by way of introduction which eliminates the above-mentioned drawbacks associated with known dispenser brushes and which provides the above-mentioned desirable advantages of a dosage which is precise and which is dispensed solely dependent on the wishes of the user, which dispenser brush may be made from simple elements making a simple assembling possible and which enables an easy, effortless activation of the pump mechanism.

SUMMARY OF THE INVENTION

This object is achieved with a dispenser brush of the type mentioned by way of introduction and characterized in that the piston pump is arranged for movement in a direction substantially normal to the longitudinal axis of the brush, that the piston member comprises an actuator button extending through an opening in the wall of the handle, that the edge of the piston member which is facing into the cylinder member is in sealing contact with the wall of the cylinder, that the cylinder member has an inlet opening arranged in the side wall and provided in the immediate vicinity of the sealing edge of the piston member when the piston member is in its position of rest, and an outlet opening provided at the sealing edge when the piston member has performed the compression stroke, which outlet opening is surrounded by a stub provided with a flange, that the inlet opening is provided with a venting member and that the outlet opening is provided with a closing member.

A dispenser brush according to the invention and as defined above is made of few individual parts, all of which are relatively inexpensive . Even though only few elements are used in the dispenser brush a very secure operation and a precise dosage of the agent to be dispensed is obtained.

With the dispenser brush a simple and quick assembling is obtained as an assembly consisting of the cylinder member, the piston member, the closing member for the outlet opening and the venting member for the inlet opening, in an assembled state, may be mounted in the handle of the dispenser brush without any risk of incorrect mounting. Moreover, the dispenser brush will be very simple to activate because the user, with a normal working grip around the handle, may activate the actuator button with the thumb and provide the dispensing in doses.

DESCRIPTION OF THE DRAWINGS

The invention will now be further explained with reference to the accompanying drawing, in which.

DETAILED DESCRIPTION OF THE PREFERRED EMBODIMENTS

Figure 1:
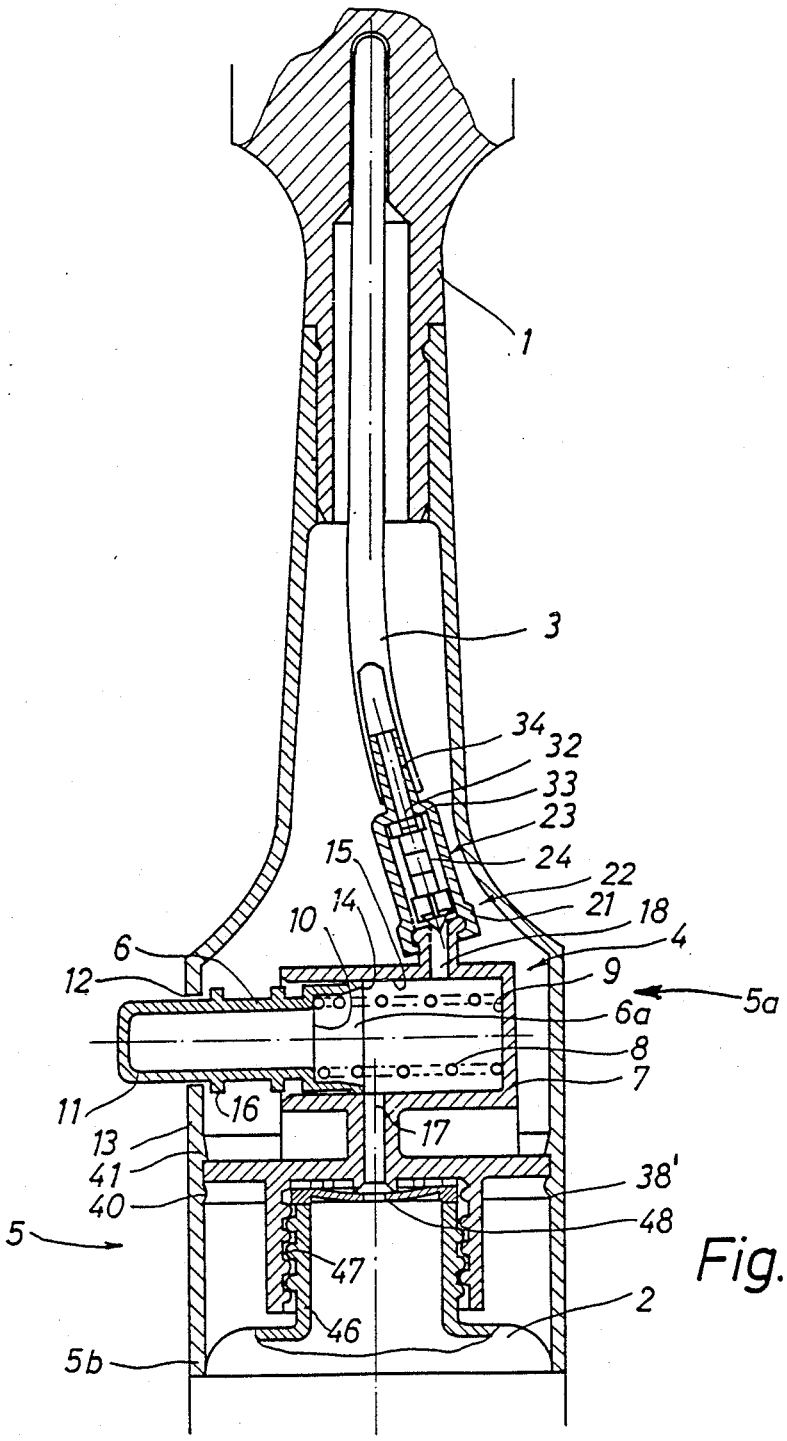
FIG. 1 is a fragmentary view, partly in section, of a dispenser brush intended for use as a dishwashing brush.

FIG. 1 shows a section through an embodiment of the dispenser brush according to the invention. This embodiment illustrates a dishwashing brush. The greater part of the brush head 1 and the greater part of the reservoir 2 are omitted for clearness . A conduit member in the form of a plastic tube 3 conveys detergent from the reservoir 2 to the brush head 1, in which one or more dispensing openings (not shown) are provided for dispensing the detergent to the bristles of the brush head.

Between the reservoir 2 and the head 1 a pump member is inserted which is provided in the form of a piston pump 4. The piston pump 4 is placed in a part 5a of the handle 5 of the brush, which part is provided adjacent the brush head 1. The piston pump 4 comprises a piston member 6, a cylinder member 7 and a spring member in the form of a coil spring 8. The coil spring 8 is made of a rustproof material to resist the agents which pass through the pump.

The spring 8 is placed between the bottom 9 of the cylinder member 7 and an abutment 10 on the piston member 6 so that a returning of the piston member to its position of rest is effected upon the termination of compression stroke.

For ease of activation the piston pump 4 is arranged for a movement substantially normal to the longitudinal axis of the brush, as it appears from FIG. 1. Due to the fact that the piston member 6 comprises an actuator button 11 extending through an opening 12 in the wall 13 of the handle, it is very simple for the user to activate the piston pump 4 in dispensing a precisely dosed quantity of the agent to the head of the brush. The end 6*a* of the piston member 6 facing into the cylinder member 7 has a radially outwardly extending edge 14 which is in sealing contact with the wall 15 of the cylinder. At the outer periphery the piston member 6 is provided with a protruding flange 16 defining the outward stroke of the piston, because the outer diameter of the flange 16 is greater than the diameter of the opening 12.

The sidewall of the cylinder member 15 is provided with an inlet opening 17 and an outlet opening 18. The inlet opening is positioned in immediate vicinity of the edge 14 of the piston when the piston is affected solely by the spring 8 and is in its position of rest with the flange 16 abutting the inside of the wall 13 of the handle. The outlet opening 18 is positioned substantially at the position the sealing edge 14 occupies when the piston member 6 has finished the compression stroke. A hollow stub 19 surrounds the outlet opening and is provided with a flange 20. The flange 20 is intended for snap engagement with a groove 21 placed in one end 22 of a valve house 23 containing a closing member for the outlet opening. The closing member consists of a non-return valve unit 24 in the form of a valve body 25 made integrally with the spring member 26 and intended to abut against a valve seat 27' 27 provided in the hollow stub 19 at the outlet opening 18.

Figure 2:
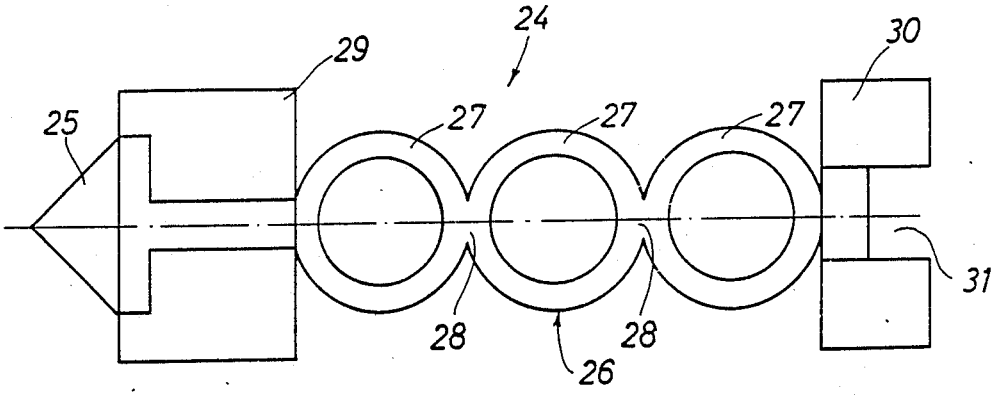
FIG. 2 is a view, on an enlarged scale, of an one-piece valve body and spring member for use in the dishwashing brush shown in FIG. 1.
Figure 3:
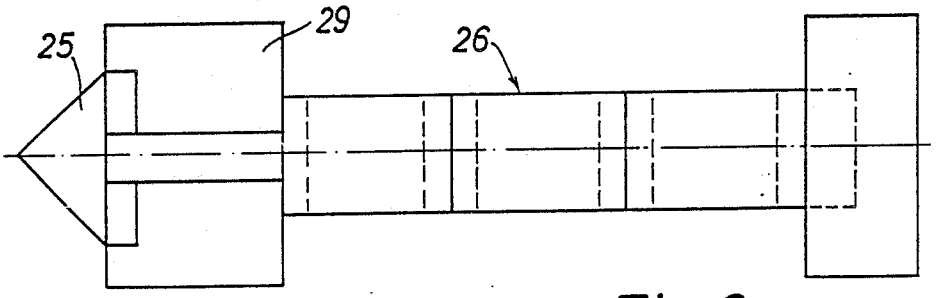
FIG. 3 is a view of the element shown in FIG. 2, illustrated in a position turned 90°.
Figure 4:
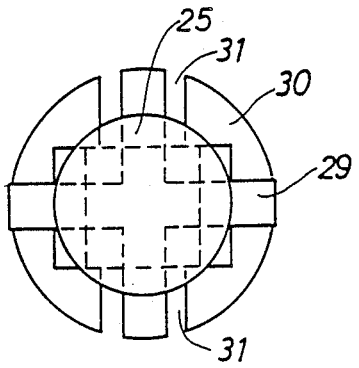
FIG. 4 is a view of the element shown in FIGS. 2 and 3, illustrated from the end where the valve body is placed.
Figure 7:
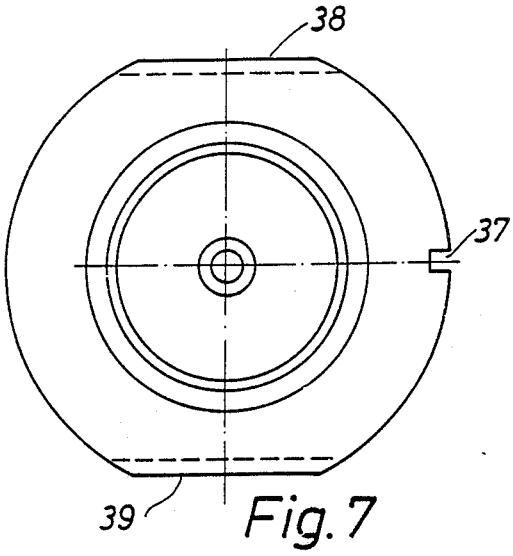
FIG. 7 is a view of the assembly shown in FIGS. 5 and 6 as seen according to section line VII—VII in FIG. 6.
Figure 8:
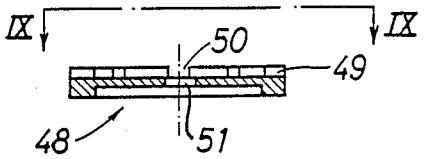
FIG. 8 is a section through a membrane for venting the reservoir.
Figure 9:
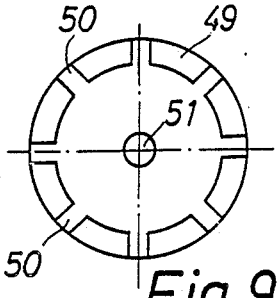
FIG. 9 is a view of the membrane shown in FIG. 8 as seen according to section line IX—IX.
Figure 5:
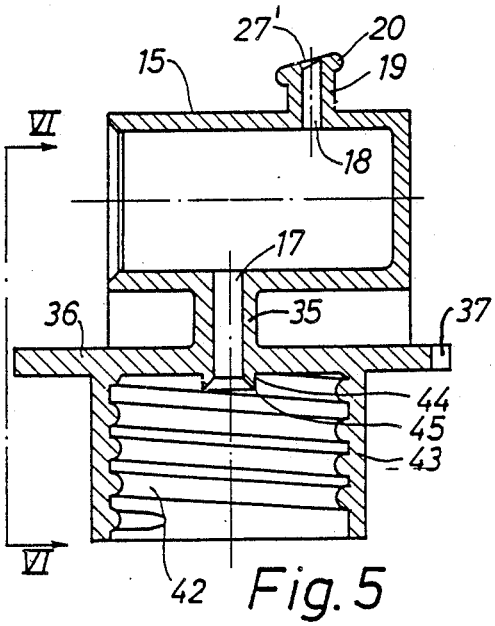
FIG. 5 is a section, on another scale, through an assembly consisting of the cylinder member made integrally with a flange and an inner thread for fastening the reservoir.
Figure 6:
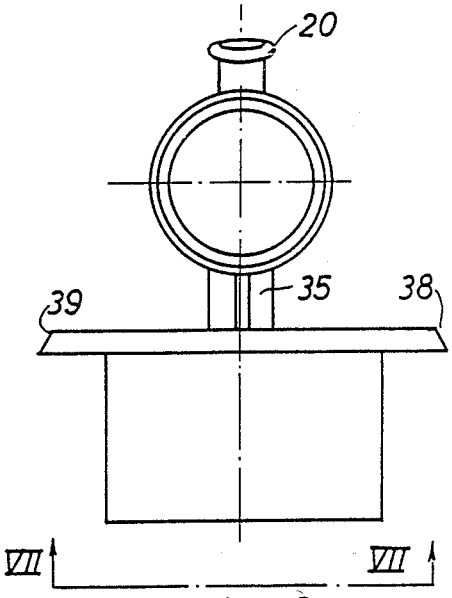
FIG. 6 is a view of the assembly shown in FIG. 5 as seen according to section line VI—VI in FIG. 5.

As can be seen from FIGS. 2,3 and 4 the spring member 26 of the unit 24 is made of tube pieces 27 which are mutually connected along a part 28 of their circumferences and which simultaneously are connected with the valve body 25 through a cross-arrangement 29 with an outer dimension substantially corresponding to the inner diameter of the valve house 23 for guiding the unit 24 in the valve house and so as to ensure the correct abutment of the valve body 25 against the valve seat 27'.

A supporting arrangement at the other end of the spring member 26 is manufactured with openings 31 to ensure the free passage of the agent out through an opening 32, passing through the bottom 33 of the valve house 23 and further through the plastic tube 3. The plastic tube 3 is secured to the valve house 23 by means of a hollow stub 34. The unit 24 thus provided is simple to manufacture by die casting because the thickness of all the walls is substantially identical. Moreover, the unit 24 is simple to assemble because the unit simply has to be placed in the valve house 23, which afterwards is firmly snapped onto the stub 19.

Hereby, the spring member 26 is compressed so that the valve body 25 presses against the valve seat 27' with a predetermined pressure. The non-return valve is positioned in the immediate vicinity of the cylinder member to eliminate the inexactness which may arise as the agent is conducted through a long flexible plastic tube, which might make a precise dosage impossible.

However, the non-return valve may in some situations be positioned near the dispensing openings in the brush head, but in such cases the, conduit member which must be arranged between the cylinder member and the non-return valve must have sufficient stiffness to be substantially un-expandable under the influence of the pressure which is caused by the piston pump.

The cylinder member is via a stub 35 made in one piece with a flange 36 for securing the cylinder member in the handle 5. At the circumference the flange 36 is provided with a recess 37 which co-operates with a ridge 381 provided diametrically opposite the opening 12 to secure the actuator button 11 circumferentially with respect to the opening 12. The flange 36 is substantially circular, however, it is cut at 38 and 39 because the handle in the embodiment illustrated does not have a completely circular cross section area for receiving the flange in the assembled condition. The cut edges, which appear at 38 and 39 further contribute to a correct fixation of the cylinder member in the handle. In the handle 5 two beads 40,41 are arranged having a mutual distance substantially corresponding to the thickness of the flange 36. The bead 40 positioned nearest the part 5b of the handle is rounded so that the flange 36 relatively easily can be displaced over this bead. At the side facing the first bead 40, the second bead 41 is provided with a relatively sharp side edge to ensure that the flange is not displaced beyond this bead 41.

Furthermore, the flange 36 comprises a member intended for connection with a member on the reservoir and provided in the form of an inner thread 42 in a tubular protrusion 43 on the flange. The inlet opening 17 is connected with the hollow interior of the stub 35 and opens through the flange 36. At the mouth it is surrounded by a protrusion 44 provided with a sharp edge 45.

The reservoir 2 has a neck part 46 which is provided with an outer thread 47 intended for engagement with the thread 42. Between the outer edge of the neck part 46 and the flange 36 a flexible membrane 48 is provided, which is intended for venting the reservoir 2 when a quantity of the agent is being dispensed. This venting is intended to prevent a vacuum blocking of the delivery of the agent to the brush head. At the outer circumference and at the area in front of the edge of the neck part 46 the membrane 48 has an upstanding edge 49 intended to abut against the flange 36 and provided with a plurality of radial openings 50. These radial openings 50 ensure that air may pass from the space between the two threads 42 and 47 to the space provided between the membrane 48 and the flange 36. A central opening 51 is provided in the membrane, which opening has a diameter less than the diameter of the sharp-edged, annular protrusion 44.

Due to the fact that the height of the annular protrusion 44 of the flange is greater than the height of the protruding edge 49 of the membrane 48, the membrane normally rests against the edge 45 of the circular protrusion 44 of the flange. However, a partial vacuum occuring in the reservoir 2 by dosing of the agent is sufficient to lift the flexible membrane 48 away from the edge 45 so that a pressure equalizing effect is obtained and thereby a vacuum blocking is prevented.

In another embodiment than the one shown one or more openings are provided in the tubular protrusion 43 in the immediate vicinity of the flange 36 for the passage of the air from the area outside the protrusion 43 to the area inside the protrusion in the immediate vicinity of the membrane.

In a construction according to the invention, each of the parts of the dispenser brush is preferably manufactured with a substantially equal wall thickness whereby an advantageous of the manufacturing is achieved.

When mounting the pump member/flange unit in the handle, the actuator button is pressed down so that the piston member is moved inside the cylinder member and has a smaller radial extension than the flange, hereafter the unit is displaced through the handle until the flange abuts against the second bead 41. In this position the actuator button 11 is arranged in front of the opening 12 and due to the effect of the spring 8 it will be urged through the opening 12.

The dosage takes place in that the user activates the actuator button 11 with the thumb while gripping around the part of the handle **5*b* facing away from the head of the brush and surrounding the reservoir 2 which may form a part of the handle or which reservoir may be placed inside the part of the handle 5*b*. Hereby, the piston member 6** is depressed one or more times dependent upon the dosage required.

When the sealing edge 14 of the piston member passes the inlet opening 127, this inlet opening will be closed and a further activation of the piston member increases the pressure of the agent inside the cylinder member. Hereby, an increase of pressure occurs which lifts the valve body 25 away from the seat 27' and allows the passage of the agent through the non-return valve 23 and further on to the brush head 1. By an appropriate dimensioning of the diameter of the cylinder member and the stroke of the piston member, it is possible beforehand to chose the volume to be dosed at each compression stroke. When the piston member has finished the compression stroke and the user relieves the pressure on the actuator button 11, the spring 8 provides the returning of the piston member and at this time the valve body 25 again will abut against the seat 27' and in this way a vacuum is created in the cylinder chamber. This vacuum will be equalized by agent flowing from the reservoir and into the cylinder member for filling the chamber, but not until the edge 14 of the valve body has passed the inlet opening 17.

The vacuum which is created in the reservoir 2 is equalized by passing between the threads 42 and 47 and through the openings 50 in the membrane and further through the slot created between the edge 45 and the membrane due to the pressure difference over the membrane. After the pressure equalizing is obtained, the membrane again will abut against the edge 45, and in this way the agent in the reservoir 2 can not flow out into the space between the threads.

I claim:

1. A dispenser brush assembly which comprises an elongated brush element which defines a longitudinal axis and which includes a head having discharge openings for a liquid, a tubular handle connected to said head, and a tube means for conveying liquid to said discharge openings, said tubular handle having a side wall with an opening for an actuator button and an entry end opposite said head, an insert assembly which includes a cylinder having a side wall and a bottom wall, a piston which is movable within said cylinder between a first position and a second position, said second position being closer to said bottom wall than said first position, an actuator button connected to said piston, a spring means biasing said piston into said first position, a first hollow stub connected to said cylinder and communicating with an outlet opening in said side wall thereof near said second position, a second hollow stub connected to said cylinder and communicating with an inlet opening in said side wall thereof near said first position, a flange connected to said second stub, said flange including an opening in communication with the interior of said second hollow stub and a tubular protrusion in which the neck of container means for liquid can be positioned, and a venting element located within said tubular protrusion and positionable between said flange and the neck of a container means positioned within said tubular protrusion, said flange being dimensioned so that said insert assembly can be inserted into the entry end of said tubular handle such that said cylinder will be perpendicularly oriented relative to said longitudinal axis and said actuator button will extend through said opening in said side wall of said tubular handle, and a closing member for preventing liquid flow into said cylinder through said first stub, movement of said piston by said actuator button from said first position of said second position within said cylinder causing a controlled amount of liquid to flow to and through said discharge openings.

2. A dispenser brush assembly according to claim 1, wherein said actuator button includes an external stop flange which abuts said side wall of said tubular handle when said piston is in said first position.

3. A dispenser brush assembly according to claim 1, wherein the side wall of said tubular handle includes two spaced, inwardly-extending annular beads, and wherein the flange of said insert assembly is dimensioned to snap fit between said two annular beads when said insert assembly is inserted in said tubular handle such that said actuator button thereof extends through said opening in said side wall of said tubular handle.

4. A dispenser brush assembly according to claim 1, wherein said flange includes a sharp-edged annular protrusion which surrounds said opening therein and which extends within said tubular protrusion and wherein said venting element comprises a flexible membrane which has a central opening whose diameter is less than a diameter of said annular protrusion, a peripheral protruding edge for abutting against said flange and a plurality of radial venting openings, said annular protrusion extending further from said flange than the thickness of peripheral protruding edge of said membrane so that said membrane normally rests against said annular protrusion and can flex to be lifted free of the annular protrusion and moved towards a container means for liquid located within said tubular protrusion by a pressure difference.

5. A dispenser brush assembly according to claim 4, wherein first stub defines a valve seat and wherein said closing member comprises a non-return valve which includes a valve house that is connectable to said first stub, a valve unit that is located within said valve house, said valve unit including a valve body which can abut said valve seat, and a spring member that biases said valve body against said valve seat.

6. A dispenser brush assembly according to claim 5, wherein said first stub includes an external annular lip therearound, and wherein said valve house includes an annular groove which snap fits over said annular lip.

7. A dispenser brush assembly according to claim 5, wherein said valve body and said spring member are made of plastic, and wherein said spring member comprises a plurality of tube pieces which are connected along outer peripheries thereof.

8. A dispenser brush assembly according to claim 4, wherein said tubular protrusion includes openings to enable venting between said flange and said membrane.

9. A dispenser brush assembly according to claim 4, wherein said tubular protrusion includes inner threads for cooperation with external threads on the neck of a container means for liquid screwed therein.

* * * * *